US005693999A

United States Patent [19]

Osamura et al.

[11] Patent Number: 5,693,999

[45] Date of Patent: Dec. 2, 1997

[54] MULTIPLE GAP SPARK PLUG FOR INTERNAL COMBUSTION ENGINE

[75] Inventors: Hironori Osamura, Chiryu; Keiji Kanao, Okazaki, both of Japan

[73] Assignee: Nippondenso Co., Ltd., Kariya, Japan

[21] Appl. No.: 616,567

[22] Filed: Mar. 15, 1996

[30] Foreign Application Priority Data

| | | | |
|---|---|---|---|
| Mar. 16, 1995 | [JP] | Japan | 7-057563 |
| Jan. 24, 1996 | [JP] | Japan | 8-009984 |

[51] Int. Cl.[6] ..... H01T 13/20

[52] U.S. Cl. ..... 313/141; 313/140

[58] Field of Search ..... 313/140, 141, 313/142

[56] References Cited

U.S. PATENT DOCUMENTS

| | | | |
|---|---|---|---|
| 2,518,844 | 8/1950 | Wetzel | 313/140 |
| 3,719,851 | 3/1973 | Burley | 313/140 |
| 3,870,918 | 3/1975 | Senda et al. | 313/140 |
| 4,465,952 | 8/1984 | Sato et al. | 313/141 |
| 4,983,877 | 1/1991 | Kashiwara et al. | 313/140 |
| 5,189,333 | 2/1993 | Kagawa et al. | 313/140 |

FOREIGN PATENT DOCUMENTS

| | | | |
|---|---|---|---|
| 60-081784 | 5/1985 | Japan | H01T 13/46 |
| 5-326107 | 12/1993 | Japan | H01T 13/32 |
| 7-130454 | 5/1995 | Japan | H01T 13/46 |
| 7-142147 | 6/1995 | Japan | H01T 13/46 |
| 1378455 | 12/1974 | United Kingdom | H01T 13/46 |

*Primary Examiner*—Michael Horabik
*Assistant Examiner*—Michael Day
*Attorney, Agent, or Firm*—Cushman, Darby & Cushman Ip Group of Pillsbury Madison & Sutro LLP

[57] ABSTRACT

A spark plug for an Internal combustion engine is provided. When it is assumed that the distance of a first spark gap (g1) defined by a central electrode (8) and a first grounding electrode (16) whose width is "A" and which is axially opposed to the central electrode, and a second spark gap (g2) defined by the central electrode and at least one second grounding electrode (21) whose width is "B" and which is opposed to the side surface of the central electrode, the relationship defined by $0.5 \leqq \Sigma Bn/A \leqq 1.5$ is established, wherein "n" represents the number of the second grounding electrode to reduce the discharge voltage of the spark plug and maintain a high heat resistance. Preferably, the spark plug satisfies the relationship defined by $0.1\ mm \leqq g2-g1 \leqq 0.4\ mm$ to improve the ignitability of the spark plug.

25 Claims, 8 Drawing Sheets

○ — SPARK PRODUCED IN FIRST SPARK GAP (DISCHARGE VOLTAGE DROP DUE TO SECOND GROUNDING ELECTRODE CAN BE EXPECTED)

△ — SPARK PRODUCED IN FIRST SPARK GAP (DISCHARGE VOLTAGE DROP DUE TO SECOND GROUNDING ELECTRODE CANNOT BE EXPECTED)

× — SPARKS PRODUCED IN FIRST AND SECOND SPARK GAPS OR SPARK PRODUCED IN SECOND SPARK GAP

MULTIPLE GAP SPARK PLUG FOR INTERNAL COMBUSTION ENGINE

BACKGROUND OF THE INVENTION

1. Field of the Invention

The present invention relates to a spark plug for an internal combustion engine.

2. Description of Related Art

Recently, in internal combustion engines for use in automobiles or the like, rigorous attempts have been made to reduce fuel consumption from a global viewpoint including environmental problems or conserving earth's resources.

In particular, for a gasoline engine, attempts have been mainly addressed to an increase of the compression ratio or to a use of a lean mixture whose air/fuel ratio is lower than a stoichiometric air/fuel ratio. However, these solutions tend to invite an increase of the discharge voltage of the spark plug. Due to an increased discharge voltage, not only is the resistance to a dielectric breakdown reduced in the ignition system, but also the discharging occurs at a portion of the spark plug other than the spark gap. This results in an unstable idling operation of the engine. Moreover, the increased discharge voltage is accelerated as the electrode wears. Under these circumstances, there has been a need for provision of spark plugs whose discharge voltage is low.

To respond to this need, for example, Japanese Unexamined Patent Publication No. 5-326107 discloses a spark plug which is provided with a plurality of grounding electrodes to reduce the discharge voltage and restrict the wearing of the electrodes.

However, in the spark plug proposed in JPP'107, neither an influence caused by the presence of the additional (second) grounding electrode nor the functional relationship between the first and second grounding electrodes are analyzed, and hence, the reduction of the discharge voltage and an increase of the wear-resistance of the electrodes are limited to some extent.

SUMMARY OF THE INVENTION

Under these circumstances, the inventors of the present invention have conducted experiments and carefully studied the details or specification of the grounding electrodes in a multiple-grounding electrode type spark plug, based on the experimental results to obtain a further improved spark plug.

It is an object of the present invention to provide a spark plug for an internal combustion engine, having a low discharge voltage, a high ignitability leading to an improved drivability of the engine, and a high heat resistance.

To achieve the object mentioned above, according to the present invention, there is provided a spark plug for an internal combustion engine comprising an insulator having a through hole, a central electrode which is held in one end of the through hole, a voltage transmitting means which is provided in the other end of the through hole and is electrically connected to the central electrode, a housing which holds therein the insulator, a first grounding electrode which is electrically connected at one end thereof to one end surface of the housing and defines at the other end a first spark gap together with a front end of the central electrode, and at least one second grounding electrode which is electrically connected at one end thereof to the housing and defines at the other end a second spark gap together with the side surface of the central electrode, wherein assuming that the width of the first grounding electrode is "A": the width of the second grounding electrode is "B": the distance of the first spark gap is g1: and the distance of the second spark gap is g2, respectively, the following relationship is established;

$0.5 \leqq \Sigma Bn/A \leqq 1.5$ ("n" represents the number of the second grounding electrodes)

$$-0.1\ \text{mm} \leqq g2-g1 \leqq 0.4\ \text{mm}.$$

Preferably, at least one of the first grounding electrode and the central electrode is provided with a front end electrode portion which is made of precious metal or a precious metal alloy.

Preferably, if the central electrode and the first grounding electrode are provided with front end electrode portions made of precious metal or a precious metal alloy, the first spark gap g1 and the second spark gap g2 satisfy the following relationship;

$$0.1\ \text{mm} \leqq g2-g1 \leqq 0.4\ \text{mm}.$$

More preferably, the first spark gap g1 and the second spark gap g2 satisfy the following relationship;

$$0.1\ \text{mm} \leqq g2-g1 \leqq 0.4\ \text{mm}.$$

In a preferred embodiment, the second spark gap satisfies the following relationship;

$$g2 \leqq 0.9\ \text{mm}.$$

More preferably, the second spark gap satisfies the following relationship;

$$g2 \leqq 1.1\ \text{mm}.$$

According to an embodiment of the present invention, the first grounding electrode is provided with a front end electrode made of a metal material selected from platinum, a platinum alloy, iridium, and an iridium alloy, and the central electrode is provided with a front end electrode made of an iridium wire or an iridium alloy wire.

The first grounding electrode can be provided with a front end electrode made of a metal material selected from platinum, a platinum alloy, iridium, and an iridium alloy, and the central electrode can be provided with a front end electrode made of an iridium wire or an iridium alloy wire.

According to another aspect of the present invention, there is provided a spark plug for an internal combustion engine comprising an insulator having a through hole, a central electrode which is held in one end of the through hole, a voltage transmitting means which is provided in the other end of the through hole and electrically connected to the central electrode, a housing which holds therein the insulator, a first grounding electrode which is electrically connected at one end thereof to one end surface of the housing and defines at the other end a first spark gap together with a front end of the central electrode, and at least one second grounding electrode which is electrically connected at one end thereof to the housing and defines at the other end a second spark gap together with the side surface of the central electrode, wherein assuming that the width of the first grounding electrode is "A": and the width of the second grounding electrode is "B": the following relationship is established;

$$0.5 \leqq \Sigma Bn/A \leqq 1.5$$

("n" represents the number of the second grounding electrodes) and wherein the first spark gap and the second spark gap are determined so that a spark can be produced only in the first spark gap.

With this arrangement, since the second grounding electrodes are provided in connection with the first grounding electrode, as specified above, the equi-voltage surface around the central electrode is concentrated to increase the intensity of the electric field, and hence the spark can be easily produced in the first spark gap defined by the central electrode and the first grounding electrode. Moreover, according to the present invention, since the width of the first grounding electrode and the width of the second grounding electrodes are determined to have a specific relationship as mentioned above, if the second grounding electrodes whose width is smaller than that of the conventional second grounding electrode are used, the intensity of the electric field can be further increased due to the edge effect of the second grounding electrodes.

BRIEF DESCRIPTION OF THE DRAWINGS

The above and other objects, features, and advantages will be made more apparent from the ensuing description of the preferred embodiments in conjunction with the accompanying drawings wherein.

DESCRIPTION OF THE PREFERRED EMBODIMENT

Figure 1:
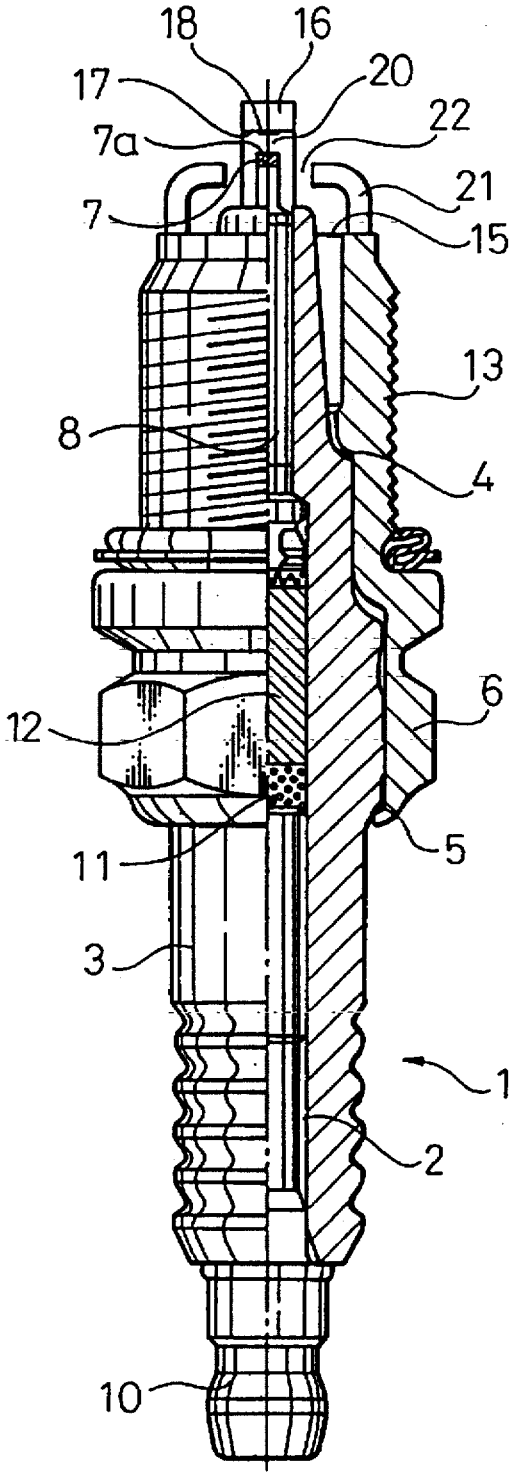
FIG. 1 is a schematic view of a spark plug for an internal combustion engine, according to a first embodiment of the present invention, wherein the right half of the spark plug is sectioned.
Figure 2A:
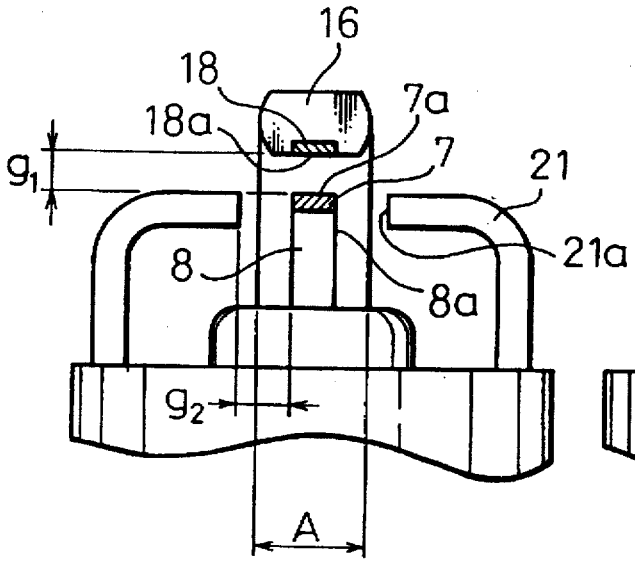
FIGS. 2A and 2B are an enlarged front elevational view and an enlarged side elevational view of a main part of a spark plug shown in FIG. 1, respectively.
Figure 2B:
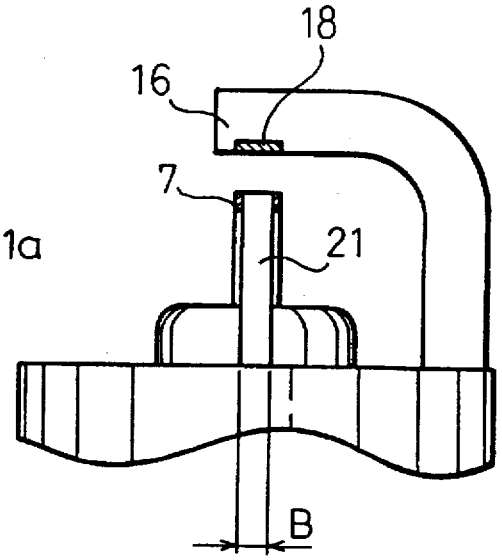

FIG. 1 shows a schematic view of a spark plug for an internal combustion engine, according to a first embodiment of the present invention, wherein only the right half is sectioned. FIGS. 2A and 2B are enlarged front and side elevational views of a main part of the spark plug shown in FIG. 1. In the drawings, the spark plug 1 for an internal combustion engine is comprised of an insulator 3 which has a through hole 2 and which is made of alumina or the like, and a metal housing 6 which is made of low-carbon steel. The insulator 3 is firmly held in the housing 6 through a metal ring 4 of copper or the like and a packing 5. A central electrode 8 which is made of a heat-resistant and corrosion-resistant material such as a nickel alloy is inserted and held in the front end (upper end) of the through hole 2 which is provided with a front electrode 7 of precious metal or a precious metal alloy. A terminal electrode 10 which is made of metal such as iron is inserted and held in the rear end (lower end) of the through hole 2. A conductive glass 11 and a resistor 12 are enclosed in the insulator 3 and between the central electrode 8 and the terminal electrode 10.

The housing 6 is provided with a threaded portion 13 at the front end thereof. A first bent grounding electrode 16 which is made of a heat-resistant and corrosion-resistant material such as a nickel alloy is secured to a front end face 15 of the housing 6. The first grounding electrode 16 is provided on the front end 17 thereof with a front end electrode 18 of precious metal or a precious metal alloy such as platinum. The lower surface (electrode surface) 18*a* of the front end of front end electrode 18 is opposed, in the longitudinal axis direction of the spark plug, to the electrode surface 7*a* of the front end (upper end) of the front end electrode 7 provided on the central electrode 8. The gap g1 between the electrode surfaces 18*a* and 7*a* defines a first spark gap 20.

A pair of second bent grounding electrodes 21 that are smaller than the first grounding electrode 16 are secured to the front end (upper end) surface 15 of the housing 15 with an angular phase difference of 90 degrees with respect to the first grounding electrode 16. Namely, in FIG. 2A, the second grounding electrodes 21 are opposed in a plane including the sheet of the drawing (FIG. 2A) perpendicular to a plane including a center axis of the first grounding electrode 16. The front end surfaces 21*a* of the second grounding electrodes 21 are opposed to the diametrically opposed side surfaces (wall portions of the peripheral surface) 8*a* of the central electrode 8. The gaps g2 between the end surfaces 21*a* and the side surfaces 8*a* define second spark gaps 22. Note that the first grounding electrode 16 and the second grounding electrodes 21 have widths "A" (FIG. 2A) and "B" (FIG. 2B), respectively.

High voltage is applied between the terminal electrode 10 and the housing 6, and is transmitted to the first or second spark gaps 20 and 22 through a voltage transmitting means which is constituted by the terminal electrode 10, the conductive glass 11, and the resistor 12.

Figure 3:
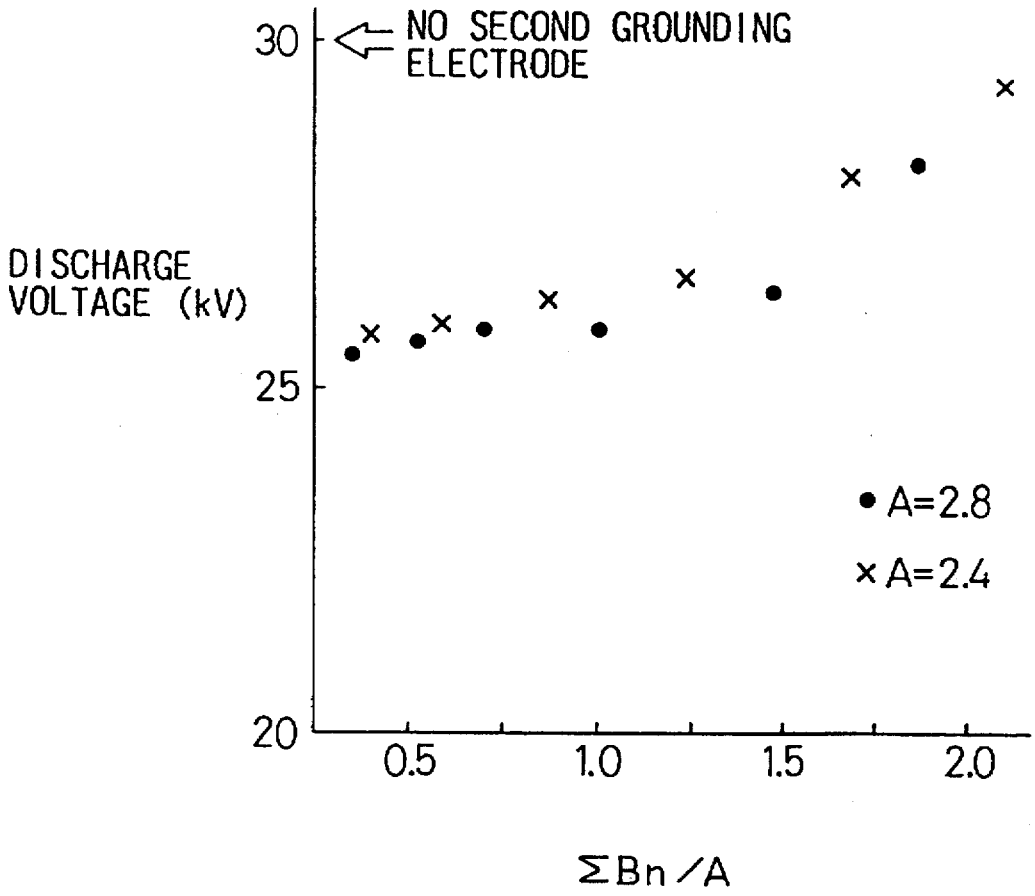
FIG. 3 is a graph showing the experimental result of Experiment 1 according to the present invention.

To produce a spark plug whose discharge voltage is low and which has an enhanced ignitability providing a high drivability of the engine and a high heat resistance, different kinds of reference spark plugs (sample spark plugs) were prepared to evaluate the discharge voltage. The details of the reference spark plugs were as follows. The width "A" of the first grounding electrodes 16 was 2.8 mm or 2.4 mm (A=2.8 mm or 2.4 mm); the width "B" of the second spark plugs was from 0.5 mm to 2.5 mm (B=0.5 mm to 2.5 mm); the distance of the first spark gap g1 was 1.1 mm (g1=1.1 mm); and, the distance of the second spark gaps g2 was 1.3 mm (g2=1.3 mm). Moreover, in order to eliminate an adverse influence of burrs, etc., the peripheral edge of the front end of the electrode surface 7*a* of the central electrode 8 and the peripheral edges of the front end surfaces 18*a* and 21*a* of the first and second grounding electrodes 16 and 21 were chamfered. The measurement results of ten experiments are shown in FIG. 3. In the experiments, a four-cylinder engine of 1800 cc was used, wherein the maximum discharge voltages obtained under no load conditions in which the throttle valve was fully opened and generally speaking, the discharge voltage becomes a maximum, were plotted, as shown in FIG. 3.

It can be seen from FIG. 3 that the discharge voltages when the width "A" of the first grounding electrode 16 was 2.8 mm and when it was 2.4 mm were about the same, and that there is a tendency for the discharge voltage to decrease as the value of ΣBn/A reduces, wherein ΣBn represents the sum of the width of the second grounding electrodes and "n" represents the number of the second grounding electrodes. In particular, when ΣBn/A is not larger than 1.5 (ΣBn/A≦1.5), the discharge voltages were remarkably reduced. This is because the concentration effect of the strong magnetic field in the vicinity of the central electrode 8 can be enhanced due to the second grounding electrodes 21, and particularly, the concentration can be promoted as the width "B" of the second grounding electrodes 21 is reduced. The number of the second grounding electrodes is not limited to two and can be more than two. For example, if there are three second grounding electrodes, ΣBN=B1+B2+B3.

Figure 4:
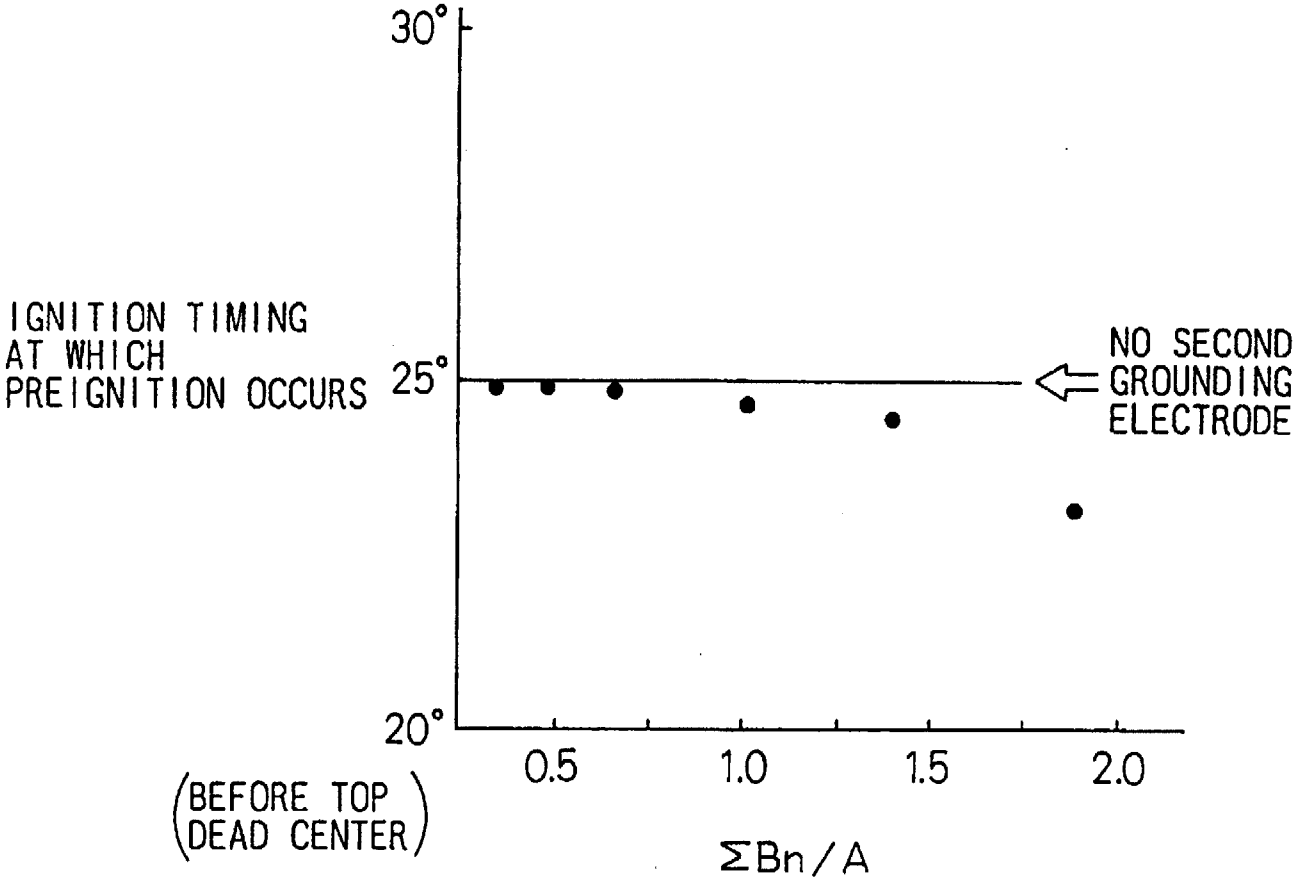
FIG. 4 is a graph showing the experimental result of Experiment 2 according to the present invention.

The experiments were also conducted to measure the heat resistance using the reference spark plugs mentioned above for measuring the discharge voltage. The experimental results are shown in FIG. 4. In the experiments, the ignition timing was advanced while driving the engine at 6000 rpm and at the full load to detect the ignition timing at which preignition occurred. In FIG. 4, the width "B" of the second grounding electrodes 21 was varied while the width "A" of the first grounding electrode 16 was constant and equal to 2.8 mm (A=2.8 mm). As can be seen in FIG. 4, the ignition timing at which the preignition occurred was gradually retarded and the heat resistance was worsened as the value of ΣBn/A increased. In particular, there is a tendency that when the value of ΣBn/A is above 1.5, the heat resistance is remarkably decreased.

As a result of the experiments, it has been found that the value of ΣBn/A must be equal to or less than 1.5 to realize a spark plug which satisfies both the requirements that the discharge voltage is low and the heat resistance is high.

The width "B" of the second grounding electrodes 21 should be preferably equal to or more than 0.75 mm to provide a sufficient corrosion resistance to the high temperature burnt gas. On the other hand, the width "A" of the first grounding electrode 16 is preferably not more than 3.0 mm to prevent the ignitability from being lowered due to an increased quenching operation. In conclusion, the value of ΣBn/A is preferably equal to or above 0.5.

Figure 5:
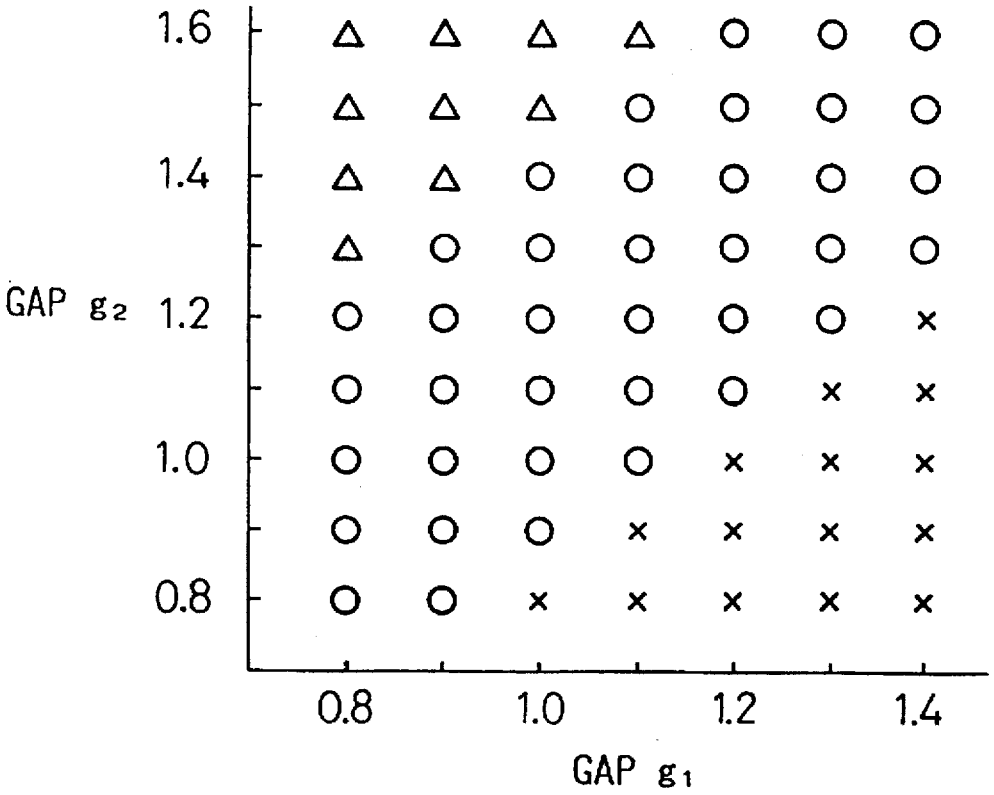
FIG. 5 is a graph showing the experimental result of Experiment 3 according to the present invention.

The following discussion will be directed to means for improving the ignitability. To increase the ignitability, the first spark gap 20 must be determined as described above. To evaluate the spark gap, we conducted experiments in which the first spark gap 20 (g1) was varied from 0.8 mm to 1.4 mm at an interval of 0.1 mm; the second spark gap 22 (g2) was changed from 0.8 mm to 1.6 mm at an interval of 0.1 mm. To observe the discharging state of the spark plugs, an engine simulating bench having a visible air-tight container in which air is tightly enclosed was used. Note that, in the experiments, the width "A" of the first grounding electrode 16 was 2.8 mm; the width "B" of the second grounding electrodes 21 was 1.4 mm; and the internal pressure of the air-tight container was 4 kg/cm$^2$, substantially corresponding to the discharge voltage under the normal engine driving conditions. The experimental results are shown in FIG. 5. In FIG. 5, the points indicated by a circle (●) represent areas in which the spark was produced by the first spark gap 20 and the discharge voltage was effectively reduced due to the second grounding electrodes. As can be seen from FIG. 5, when the difference (g2−g1) between the distance of the second spark gaps g2 and the distance of the first spark gap g1 is larger than −0.1 mm, the spark can be produced in the first spark gap g1. Namely, the intensity of the electric field is greater at the front electrode surface 7*a* of the central electrode 8 than at the peripheral side surface 8*a* of the central electrode 8, owing to an edge effect, and as a consequence, even if the first spark gap g1 is larger than the second spark gap g2 by 0.1 mm, the spark was produced in the first spark gap g1. Also, in FIG. 5, the points indicated by a triangle (Δ) represent areas in which the reduction of the discharge voltage by the second grounding electrodes 21 was hardly achieved since the second spark gaps g2 are considerably larger than the first spark gap g1.

As can be understood from the foregoing, the following relationship was found between the first and second spark gaps g1 and g2, which specifies the requirements to improve the ignitability to thereby restrict a fluctuation in the torque of the engine and reduce the discharge voltage owing to the second grounding electrodes 21;

$$-0.1\text{ mm} \leqq g2-g1 \leqq 0.4\text{ mm}$$

If the central electrode and the first grounding electrode are provided with front end electrodes made of precious metal or a precious metal alloy, it is, generally speaking, required that the duration (service life) thereof is more than 100,000 km (distance travelled). To this end, and taking into account an increase of the first spark gap g1 caused by the wearing of the electrode tips, the above mentioned relationship is preferably replaced by $$0.1\text{ mm} \leqq g2-g1 \leqq 0.4\text{ mm}$$

The low temperature startability of an engine using the spark plug as constructed above will be discussed below. At the cranking before the commencement of the combustion upon starting the engine, fine particles of fuel injected are applied to the electrodes. If the applied fine particles of fuel are accumulated on the electrodes, the spark gap can be bridged by the stacked fuel particles. The occurrence of the bridge appears more remarkably in the second spark gaps g2, so that the startability of the engine is considerably deteriorated, thus sometimes resulting in a failure to start. To prevent this, the experiments were conducted wherein the second spark gaps were varied to evaluate the startability to thereby determine the optimum value of the second spark gap.

Figure 6:
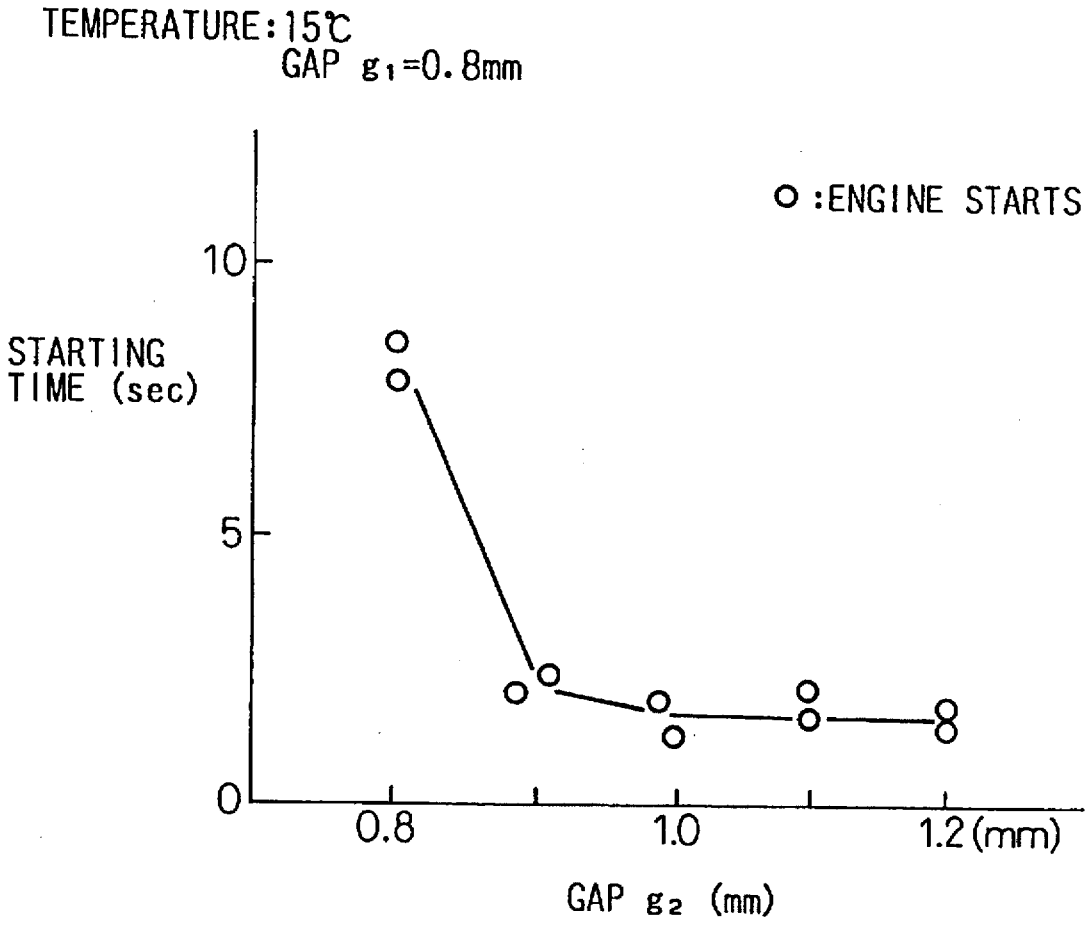
FIG. 6 is a graph showing the evaluation result of a spark plug according to the first embodiment, based on the experiments which were conducted in a cryogenic test chamber at −15° C., equivalent to a normal cold district.

The experimental results are shown in FIG. 6 in which the evaluation was carried out using a cryogenic test chamber at −15° C. corresponding to a normal cold district. The test engine used was a four cylinder engine of 2000 cc for automobiles. The spark plug used was one according to the first embodiment mentioned above, in which the first spark gap g1 was fixed to be 0.8 mm and the second spark gaps g2 were changed from 0.8 mm to 1.2 mm at an interval of 0.1 mm. Also, the width of the second grounding electrodes was 2.0 mm, and the width of the first grounding electrode was 2.8 mm, respectively.

It was found from FIG. 6 that there was no problem with the startability when the second spark gap g2 was not less than 0.9 mm.

On the other hand, if the second spark gap g2 was smaller than 0.9 mm, the startability was remarkably worsened. This seems to be because, as mentioned above, if the second spark gap g2 is small, the bridge of the fuel particles would occur during the cranking, so that engine stalls. In conclusion, for a normal cold district, the second spark gaps g2 should be equal to or larger than 0.9 mm (g2≧0.9 mm).

Figure 7:
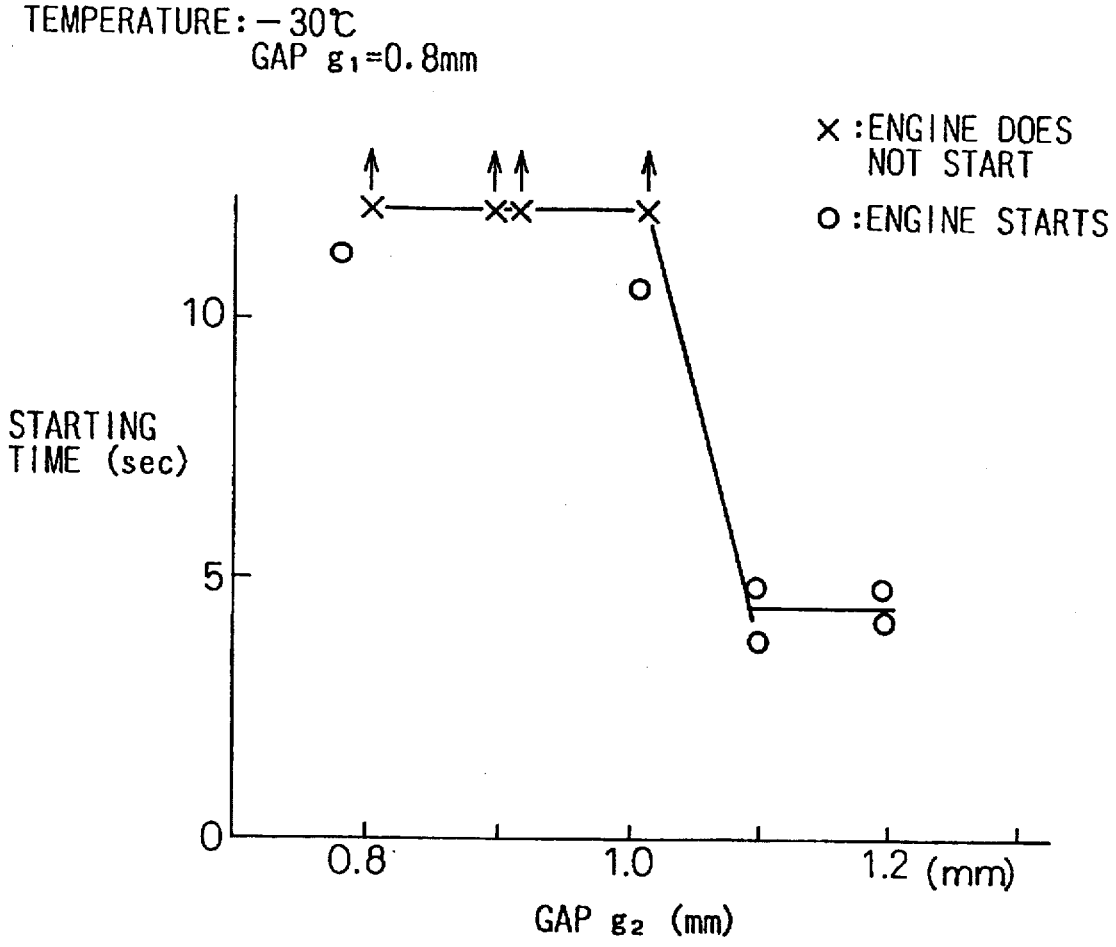
FIG. 7 is a graph showing the evaluation result of a spark plug according to the first embodiment, based on the experiments which were conducted in a cryogenic test chamber at −30° C., equivalent to an extremely cold district.

FIG. 7 shows the experimental results in a cryogenic test chamber at −30° C., corresponding to an extremely cold district.

In the experiments, the test engine and the spark plugs used were same as those mentioned above. It was found from the experiments that the ignitability became worse when the second spark gap g2 was not more than 1.1 mm. It can be considered that the reasons that the startability became worse when the second spark gap g2 was not greater than the second spark plug at the temperature of −15° C. in the experiments mentioned above are that the fuel cannot be effectively atomized at the temperature of −30° C. and the diameters of the fuel particles are large and hence the fuel particles can be easily accumulated on the electrode surfaces, thus resulting in an easy occurrence of the fuel bridge. In conclusion, to ensure the good startability in an extremely cold district, the following relationship must be established;

$$g2 \geqq 1.1 \text{ mm}$$

The evaluation experiments were conducted for the first spark gap which was identical to 1.2 mm at the temperature of −15° C. or −30° C., and like results were obtained.

Figure 8:
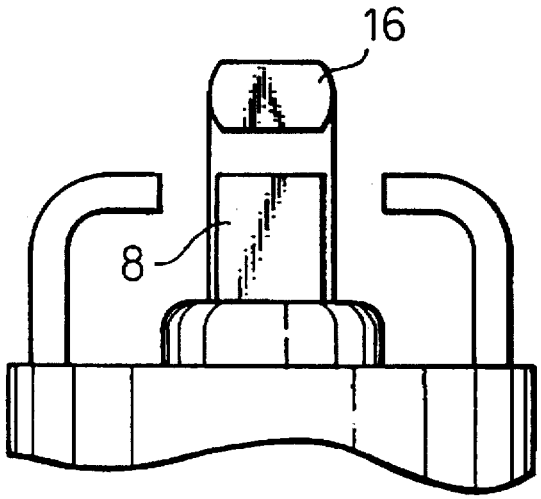
FIG. 8 is an enlarged front elevational view of a main part of a spark plug for an internal combustion engine, according to a second embodiment of the present invention; and, FIG. 9 is an enlarged front elevational view of a main part of a spark plug for an internal combustion engine, according to a third embodiment of the present invention.

FIG. 8 shows an enlarged front elevational view of a main part of a second embodiment of the present invention. In this embodiment, no precious metal tips or precious metal alloy tips are provided on the front end of the central electrode 8 or the first grounding electrode 16, unlike the first embodiment. Nevertheless, the same effects as the first embodiment could be obtained as a result of the experiments which were conducted in the same way as the first embodiment.

In general, for a spark plug in which the front end of the central electrode and the front end of the grounding electrode are not provided with precious metal tips or precious metal alloy tips, the duration (service life) is required to be more than 50,000 km (distance travelled). In view of an enlargement of the first spark gap g1 due to the wear of the electrode, the following relationship should preferably be satisfied;

$$0.2 \text{ mm} \leqq g2-g1 \leqq 0.4 \text{ mm}$$

Figure 9:
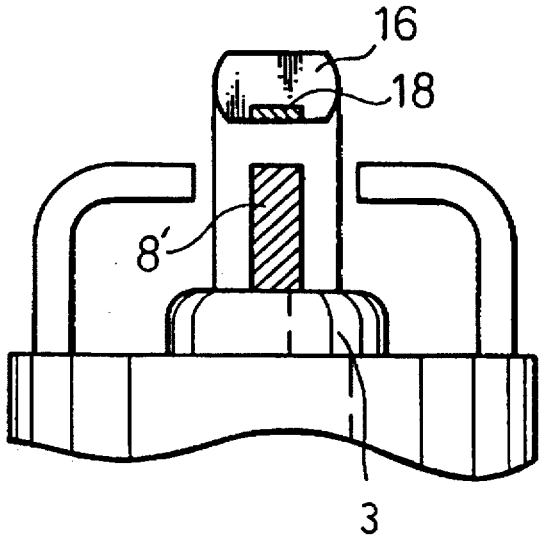

FIG. 9 shows an enlarged front elevational view of a main part of a third embodiment of the present invention. In the third embodiment, the front end portion 8' of the central electrode 8 that projects outward (upward) from the end of the insulator 3 adjacent to a combustion chamber (not shown) is made of heat-resistant precious metal, such as iridium (wire) or an iridium alloy (wire). Also, the front end electrode 18 of the first grounding electrode 16 is made of a platinum tip as in the first embodiment. As a result of the experiments which were conducted in the same way as the first embodiment, similar effects could be obtained.

According to the present invention, since the second grounding electrodes are provided in connection with the first grounding electrode, as specified above, the equivoltage surface around the central electrode is concentrated to increase the intensity of the electric field, and hence the spark can be easily produced in the first spark gap defined by the central electrode and the first grounding electrode. Moreover, according to the present invention, since the width of the first grounding electrode and the width of the second grounding electrodes are determined to have a specific relationship as mentioned above, if second grounding electrodes whose width is smaller than that of the conventional second grounding electrode are used, the intensity of the electric field can be further increased due to the edge effect of the second grounding electrodes.

Furthermore, according to the present invention, the low temperature startability in a cold district or extremely cold district can be enhanced.

Finally, it should be understood that many modifications and variations will occur to a person skilled in the art without departing from the spirit and scope of the accompanying claims.

What is claimed is:

1. A spark plug for an internal combustion engine comprising:

an insulator having a through hole;

a central electrode which is held in one end of the through hole;

a voltage transmitting means which is provided in another end of the through hole and electrically connected to the central electrode;

a housing which holds therein the insulator;

a first grounding electrode which is electrically connected at one end thereof to one end surface of the housing and defines at another end of the first grounding electrode a first spark gap g1 together with a front end of the central electrode, and at least two second ground electrodes, each being electrically connected at one end thereof to the housing and defining at the other end of the each one of the at least two second electrodes a second spark gap g2 together with a side surface of the central electrode, wherein:

assuming that a width of first grounding electrode is "A"; and a width of the each one of the at least two second grounding electrodes is "B"; a following relationship is established:

$$0.5 \leqq \Sigma Bn/A \leqq 1.5$$

where "n" represents a number of the at least two second grounding electrodes, and the first spark gap and the second spark gap are determined so that a spark can be produced only in the first spark gap.

2. A spark plug for an internal combustion engine according to claim 1, wherein the first spark gap and the second gap satisfy a following relationship:

$$-0.1 \text{ mm} \leqq g2-g1 < 0.4 \text{ mm}.$$

3. A spark plug for an internal combustion engine according to claim 2, wherein the second spark gap satisfies a following relationship:

$$g1 \geqq 0.9 \text{ mm}.$$

4. A spark plug for an internal combustion engine according to claim 2, wherein the second spark gap satisfies a following relationship:

$$g2 \leqq 1.1 \text{ mm}.$$

5. A spark plug for an internal combustion engine according to claim 1, wherein at least one of the central electrode, the first grounding electrode and the at least two second grounding electrodes is provided with a front end electrode portion which is made of precious metal or a precious metal alloy.

6. A spark plug for an internal combustion engine according to claim 5, wherein the first spark gap and the second gap satisfy a following relationship:

$$0.1 \text{ mm} \leqq g2-g1 < 0.4 \text{ mm}.$$

7. A spark plug for an internal combustion engine according to claim 6, wherein the second spark gap satisfies a following relationship:

$$g2 \geqq 0.9 \text{ mm}.$$

8. A spark plug for an internal combustion engine according to claim 6, wherein the second spark gap satisfies a following relationship:

$$g2 \geqq 1.1 \text{ mm.}$$

9. A spark plug for an internal combustion engine according to claim 1, further comprising:

a conductive glass;

a resistor; and the voltage transmitting means comprises a terminal electrode held in the other end of the through hole, wherein the conductive glass and the resistor are enclosed in the insulator between the central electrode and the terminal electrode.

10. A spark plug for an internal combustion engine comprising:

an insulator having a through hole;

a central electrode which is held in one end of the through hole;

a voltage transmitting means which is provided in another end of the through hole and is electrically connected to the central electrode;

a housing which holds therein the insulator;

a first grounding electrode which is electrically connected at one end thereof to one end surface of the housing and defines at another end of the first grounding electrode a first spark gap together with a front end of the central electrode; and at least one second grounding electrode which is electrically connected at one at least one end thereof to the housing and defines at another end of the second grounding electrode a second spark gap together with a side surface of the central electrode, wherein:

assuming that a width of the first grounding electrode is "A"; a width of the at least one second grounding electrode is "B"; a distance of the first spark gap is g1; and a distance of the second spark gap is g2; a following relationship is established:

$$0.5 \leqq \Sigma Bn/A \leqq 1.5,$$

where "n" represents a number of the at least one second grounding electrode, the central electrode and the first grounding electrode are provided with front end electrode portions made of precious metal or a previous metal alloy, and the first spark gap and the second spark gap satisfy a following relationship:

$$0.1 \text{ mm} < g2 - g1 < 0.4 \text{ mm.}$$

11. A spark plug for an internal combustion engine according to claim 10, wherein the second spark gap satisfies a following relationship:

$$g2 \leqq 0.9 \text{ mm.}$$

12. A spark plug for an internal combustion engine according to claim 10, wherein the second spark gap satisfies a following relationship:

$$g2 \geqq 1.1 \text{ mm.}$$

13. A spark plug for an internal combustion engine according to claim 10, wherein:

the first grounding electrode is provided with a front end electrode made of a metal material selected from platinum, a platinum alloy, iridium, and an iridium alloy, and the central electrode is provided with a front end electrode made of an iridium wire or an iridium alloy wire.

14. A spark plug for an internal combustion engine according to claim 10, wherein:

the first grounding electrode is provided with a front end electrode made of a metal material selected from platinum, a platinum alloy, iridium, and an iridium alloy, and the central electrode is provided with a front end electrode made of platinum or a platinum alloy.

15. A spark plug for an internal combustion engine according to claim 10, further comprising:

a conductive glass;

a resistor; and the voltage transmitting means comprises a terminal electrode held in the other end of the through hole, wherein the conductive glass and the resistor are enclosed in the insulator between the central electrode and the terminal electrode.

16. A spark plug for an internal combustion engine comprising:

an insulator having a through hole;

a central electrode which is held in one end of the through hole;

a voltage transmitting means which is provided in another end of the through hole and is electrically connected to the central electrode;

a housing which holds therein the insulator;

a first grounding electrode which is electrically connected at one end thereof to one end surface of the housing and defines at the other end of the first grounding electrode a first spark gap together with a front end of the central electrode; and at least one second grounding electrode which is electrically connected at one at least one end thereof to the housing and defines at another end of the at least one second grounding electrode a second spark gap together with a side surface of the central electrode, wherein:

assuming that a width of the first grounding electrode is "A"; a width of the at least one second grounding electrode is "B"; a distance of the first spark gap is g1; and a distance of the second spark gap is g2; a following relationship is established:

$$0.5 \leqq \Sigma Bn/A \leqq 1.5,$$

where "n" represents a number of the at least one second grounding electrode, at least one of the first grounding electrode and the central electrode is provided with a front end electrode portion which is made of precious metal or a precious metal alloy, and the first spark gap and the second spark gap satisfy a following relationship:

$$0.1 \text{ mm} \leqq g2 - g1 \leqq 0.4 \text{ mm.}$$

17. A spark plug for an internal combustion engine according to claim 16, wherein the second spark gap satisfies a following relationship:

$$g2 \geqq 0.9 \text{ mm.}$$

18. A spark plug for an internal combustion engine according to claim 16, wherein the second spark gap satisfies a following relationship:

$g2 \geqq 1.1$ mm.

19. A spark plug for an internal combustion engine according to claim 16, wherein:

the first grounding electrode is provided with a front end electrode made of a metal material selected from platinum, a platinum alloy, iridium, and an iridium alloy, and the central electrode is provided with a front end electrode made of an iridium wire or an iridium alloy wire.

20. A spark plug for an internal combustion engine according to claim 16, wherein:

the first grounding electrode is provided with a front end electrode made of a metal material selected from platinum, a platinum alloy, iridium, and an iridium alloy, and the central electrode is provided with a front end electrode made of platinum or a platinum alloy.

21. A spark plug for an internal combustion engine according to claim 16, further comprising:

a conductive glass;

a resistor; and the voltage transmitting means comprises a terminal electrode held in the other end of the through hole, wherein the conductive glass and the resistor are enclosed in the insulator between the central electrode and the terminal electrode.

22. A spark plug for an internal combustion engine comprising:

an insulator having a through hole;

a central electrode which is held in one end of the through hole;

a voltage transmitting means which is provided in another end of the through hole and is electrically connected to the central electrode;

a housing which holds therein the insulator;

a first grounding electrode which is electrically connected at one end thereof to one end surface of the housing and defines at another other end of the first grounding electrode a first spark gap together with a front end of the central electrode; and at least one second grounding electrode which is electrically connected at one end thereof to the housing and defines at another end of the at least one second grounding electrode a second spark gap together with a side surface of the central electrode, wherein:

assuming that a width of the first grounding electrode is "A"; a width of the at least one second grounding electrode is "B"; a distance of the first spark gap is g1; and a distance of the second spark gap is g2; a following relationship is established:

$$0.5 \leqq \Sigma Bn/A \leqq 1.5,$$

where "n" represents a number of the at least one second grounding electrode, and $$0.2 \text{ mm} \leqq g2-g1 \leqq 0.4 \text{ mm}.$$

23. A spark plug for an internal combustion engine according to claim 22, further comprising:

a conductive glass;

a resistor; and the voltage transmitting means comprises a terminal electrode held in the other end of the through hole, wherein the conductive glass and the resistor are enclosed in the insulator between the central electrode and the terminal electrode.

24. A spark plug for an internal combustion engine comprising:

an insulator having a through hole;

a central electrode which is held in one end of the through hole;

a voltage transmitting means which is provided in another end of the through hole and is electrically connected to the central electrode;

a housing which holds therein the insulator;

a first grounding electrode which is electrically connected at one end thereof to one end surface of the housing and defines at another end of the first grounding electrode a first spark gap together with a front end of the central electrode; and at least one second grounding electrode which is electrically connected at one end thereof to the housing and defines at another end of the at least one second grounding electrode a second spark gap together with a side surface of the central electrode, wherein:

assuming that a width of the first grounding electrode is "A"; a width of the at least one second grounding electrode is "B"; a distance of the first spark gap is g1; and a distance of the second spark gap is g2; a following relationship is established:

$$0.5 \leqq \Sigma Bn/A \leqq 1.5,$$

where "n" represents a number of the at least one second grounding electrode, at least one of the first grounding electrode and the central electrode is provided with a front end electrode portion which is made of precious metal or a precious metal alloy, and the first spark gap and the second spark gap satisfy a following relationship:

$$0.2 \text{ mm} \leqq g2-g1 < 0.4 \text{ mm}.$$

25. A spark plug for an internal combustion engine according to claim 24, further comprising:

a conductive glass;

a resistor; and the voltage transmitting means comprises a terminal electrode held in the other end of the through hole, wherein the conductive glass and the resistor are enclosed in the insulator between the central electrode and the terminal electrode.

* * * * *